US006517453B2

(12) United States Patent
LaSee

(10) Patent No.: US 6,517,453 B2
(45) Date of Patent: Feb. 11, 2003

(54) BOWFISHING ARROW ATTACHMENT

(76) Inventor: Jack LaSee, 308 W. Cedar St., Abbotsford, WI (US) 54405

( * ) Notice: Subject to any disclaimer, the term of this patent is extended or adjusted under 35 U.S.C. 154(b) by 0 days.

(21) Appl. No.: 09/891,918

(22) Filed: Jun. 26, 2001

(65) Prior Publication Data

US 2002/0198072 A1 Dec. 26, 2002

(51) Int. Cl.[7] ..... F42B 6/04
(52) U.S. Cl. ..... 473/578; 124/86
(58) Field of Search ..... 473/578, 585, 473/586; 124/23.1, 86

(56) References Cited

U.S. PATENT DOCUMENTS 3,227,454 A * 1/1966 Ellenburg ..... 124/23.1 X
4,744,347 A * 5/1988 Dodge ..... 124/86
4,801,151 A * 1/1989 Sturm et al. ..... 473/578
4,846,481 A * 7/1989 Wageman ..... 473/578
5,022,658 A * 6/1991 Burkhart ..... 473/578
5,119,579 A * 6/1992 Hullihen et al. ..... 473/578 X
5,496,041 A * 3/1996 Broussard ..... 473/578
5,609,147 A * 3/1997 Withorn ..... 124/86

* cited by examiner

*Primary Examiner*—John A. Ricci
(74) *Attorney, Agent, or Firm*—Quarles & Brady LLP

(57) ABSTRACT

The present invention provides an improved bowfishing arrow that prevents the bowfishing line from tangling with the bow string during release which can cause the arrow to snap back to cause serious injury. The improved arrow achieves this prevention by including a slide and a stop on the arrow shaft. The bowfishing line is tied to the slide which stays in front of the archer's hand and the arrow rest during drawback. After arrow release, the slide slides back to the stop, which is located close to the rearward end of the arrow. The stop is designed to not touch the arrow rest or the bow handle during release. Because the slide slides back to the rearward end of the arrow during release, the rubbing of the fishing line against the arrow shaft and thus the wear of the fishing line is greatly reduced.

25 Claims, 4 Drawing Sheets

BOWFISHING ARROW ATTACHMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The sport of bowfishing involves using a bow and arrow to catch fish. Bowfishermen typically tie a bowfishing line to the tail of the arrow. This is done to recover the arrow, and possibly a fish, following shooting an arrow into the water. The bow for bowfishing therefore includes a reel to recover the line attached to the arrow as a part of the equipment. U.S. Pat. No. 4,383,516 shows a reel for a bowfishing line that attaches to the bow and can be used to reel back in the line attached to the arrow.

However, the attachment of the bowfishing line to the tail of the arrow can lead to dangerous conditions. In particular, if the line attached to the arrow tangles with the bow string during release of the arrow, such a tangle can result in a snap back of line, which can propel the arrow back at the fisherman. Since the arrow must be tethered in order to recover the arrow and any fish hit, providing a mechanism to minimize any tangle between the line and the bow is an important safety feature of bowfishing equipment.

Juelg, Jr. et al., U.S. Pat. No. 4,905,397 disclosed a bowfishing arrow that allows the fishing line to be tied to the front portion of the arrow. However, a disadvantage of tying the fishing line to the front portion of the arrow is that the drag of the line can cause the arrow not to fly true to its target.

Gannon, U.S. Pat. No. 5,553,413, disclosed a bowfishing arrow that has a sliding stop and a fixed stop on the arrow shaft. The sliding stop and the fixed stop are designed to prevent the arrow from completely passing through the fish. As is common in the prior art, the line is attached to the rear end of the arrow, which must lie in the bowstring during the pull of the bow, thereby requiring that the segment of the line adjacent to the arrow must pass closely by the bow during launch of the arrow.

The prior does not provide a mechanism to minimize any possibility of the tangling of the line with the bowstring during arrow launch.

BRIEF SUMMARY OF THE INVENTION

The present invention provides an improved bowfishing arrow that prevents the bowfishing line from tangling with the bow string during release which can cause the arrow to snap back to cause serious injury. The improved arrow achieves this prevention by including a slide and a stop on the arrow shaft. The bowfishing line is tied to the slide which stays in front of the archer's hand and the arrow rest during drawback. During release, the arrow flies forward, through the slide until the slide hits the stop, which is located at the rearward end of the arrow. The stop is designed to not touch the arrow rest or the bow handle during release. Because the slide slides back to the rearward end of the arrow during release, the rubbing of the fishing line against the arrow shaft and thus the wear of the fishing line is greatly reduced during the period that the arrow is moving toward an intended target.

Besides the safety benefit and low fishing line wear, other objects and advantages of the present invention, such as the prevention of sand wedging between the slide and the arrow shaft and the easiness and quickness of tying the fishing line to the slide, will become apparent from the following detailed descriptions of specific embodiments of the invention.

DETAILED DESCRIPTION OF THE INVENTION

Figure 1:
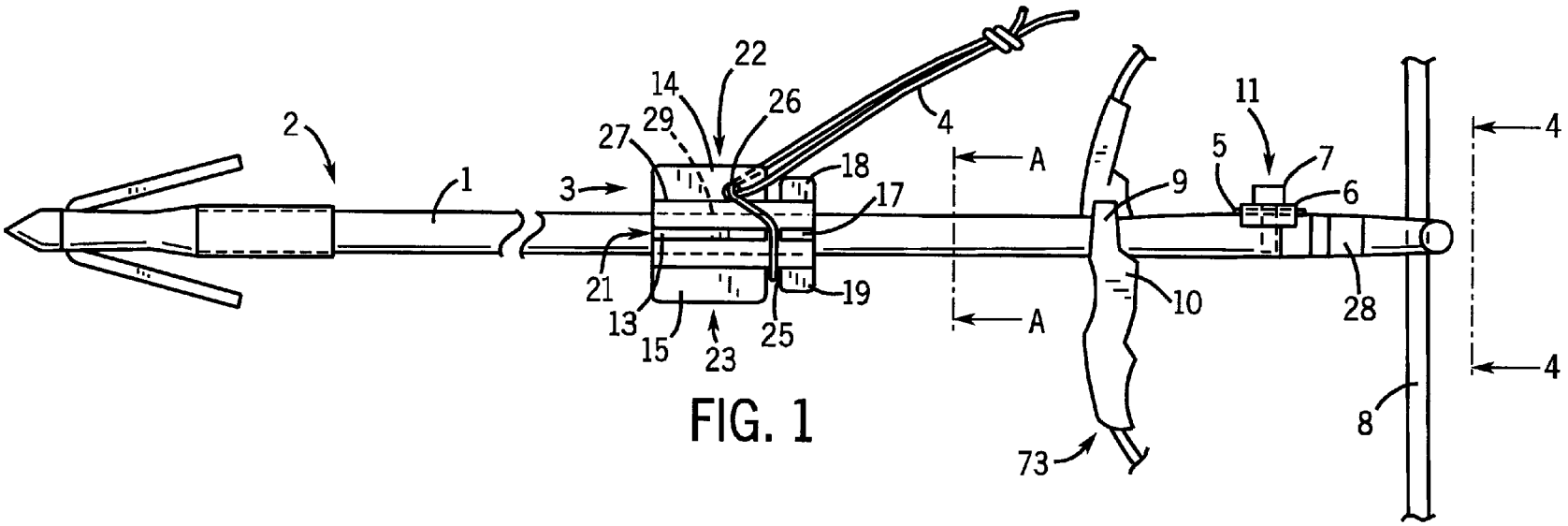
FIG. 1 is a fragmentary side view of the bowfishing arrow of the present invention showing that the bowfishing arrow has a slide and a stop with a bowfishing line tied to the slide.

Shown in FIGS. 1–4 is illustrated a bowfishing arrow 2 designed to be shot from a bowfishing bow 73. The bowfishing bow and reel is otherwise conventional and is preferably of the type shown in U.S. Pat. 4,383,516, the specification of which is hereby incorporated by reference. The arrow has riding upon it a slide 3 that can slide along the shaft 1 of the arrow. A stop 11 is provided near the proximal end of the arrow 2, the stop 11 serving to prevent the slide 3 from sliding back any further along the shaft 1. The slide 3 is formed generally in the shape of an annular cylinder 12 with an outer wall surface 27 and an inner wall surface 29. The inner wall surface 29 defines an opening 39 slightly larger than the diameter of the shaft 1 of the arrow 2 to allow the slide 3 to surround and sliding on an arrow shaft 1. The slide 3 is provided with four designated 21, 22, 23 and 24, projecting radially outwardly from the outer wall surface 27 of the cylinder 12. The vanes on the slide 3 provide directional stability for the arrow 2 both in air and water, much like the feather or fletchings attached to arrows not intended for bowfishing. The vanes on the slide 3 are better for bowfishing than standard arrow fletchings would be because standard arrow fletchings do not stand up to the physical abuse which a bowfishing arrow will encounter.

Figure 3:
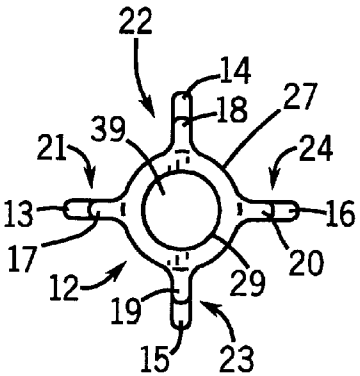
FIG. 3 is a sectional view taken along lines A—A of FIG. 1.
Figure 2:
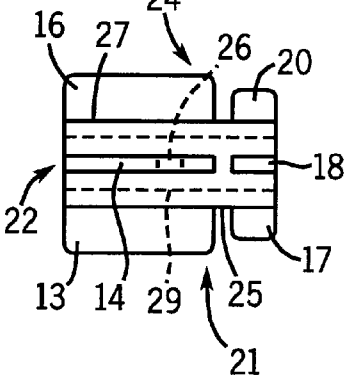
FIG. 2 is a top plan view of the slide in FIG. 1.

Although the slide 3 in the embodiment depicted in FIG. 3 has four vanes, it should be understood that other numbers of vanes such as two, three, five, and six can also be used. Each of the four vanes shown in FIGS. 1–3 are separated into a larger front portion (13, 14, 15 and 16) and a smaller back portion (17, 18, 19 and 20) by a concave circumferential notch 25 in the vanes. In the embodiment depicted in FIGS. 1–3, the back portion of each of the vanes is somewhat lower in height, or smaller radial direction, than the front potion of each of the vanes. The concave notch 25 extends all the way down to the outer wall surface 27 of the cylinder 12 in the embodiment shown in FIG. 1, but the concave configuration 25 does not need to extend all the way to the outer wall surface 27 of the cylinder 12. Alternatively, if desired, the concave notch 25 can extend into the outer wall surface 27 of the cylinder 12 to form a groove on the outer wall surface 27 of the cylinder 12. The front portion 14 of the vane 21 contains a line passage 26 at a position proximal to the cylinder 12 for passing through a bowfishing line 4. The slide 3 can be made of any number of rigid and durable materials, but preferable is made of a durable molded plastic resin material.

The fishing line 4 is attached at its proximal end to the bow reel and at its far end is attached to the arrow 2. The line 4 is attached to the arrow by being looped through the passage 26 in the vane 22, then looped around the notch 25, and passed back through the passage 26, after which the line 4 is attached by a knot to itself. To attach the fishing line 4 to the arrow 2, a loop of the line 4 is passed through the passage 26 and slipped over the rear end of the slide 3 in the notch 25, returned through the passage 26 and tied to itself.

The stop 11 of the bowfishing arrow 2 is formed of a pad 5, a cover or washer 6 to confine the pad 5, and a screw 7 to hold the cover 6 and the pad 5 in place on the rearward end of the arrow shaft 1. A preferred material for the pad 5 is urethane. The cover 6 may be made of any rigid and durable material. A preferable material for making the cover 6 is stainless steel.

In the operation of a bowfishing bow and arrow in accordance with present invention, when the arrow 2 is drawn back in the bow, the slide 3 stays in front of an archer's hand and the arrow rest 9 during the draw. As the arrow is drawn back, the slide 3 slides forwardly along the shaft of the arrow 2 The slide 3 ends up relatively neat the front of the arrow when the bow is fully drawn. Then when the bow is released, the arrow proceeds forwardly with greater force than the slide 3, and the slide slides rearwardly along the shaft of the arrow. Ultimately the slide abuts the slide stop 11. The slide stop 11 is designed to not touch the arrow rest 9 or the bow handle 10 during release. Notice that at all time in this process, the connection between the line and the arrow, or really the connection between the line and the slide, remains in front of the bow and the bowstring 8. The line therefore only need extend from the bottle holding the line to the slide 3 on the arrow, which will at that point be located very close by. So the amount of line withdrawn from the reservoir or bottle is small and all that line stays in front of the bow. When the line is withdrawn by the arrow in flight, again all of the line is in front of the bow. Therefore, the present invention minimizes the possibility of dangerous tangling of the fishing line and the bow string since the two are always far apart from each other. The point of connection of the line to the arrow is at all times in front of both the bow handle and the bow string. This is in contrast to the prior art when the attachment of the line to the arrow is at the rear of the arrow, which is right next to the bowstring when the bow is drawn. The present invention also reduces the fishing line wear by reducing the rubbing of the fishing line against the arrow shaft when the arrow is launched toward an intended target. The fishing line wear can be further reduced by wrapping a tape 28 around the arrow shaft at a position immediately after the stop.

Another advantage of the slide 3 is that it helps to prevent the arrow passing completely through of the fish. Arrow passage completely through the fish is not normally desired. Arrow passthrough makes it more difficult to recover the fish and remove it from the equipment.

Figure 5:
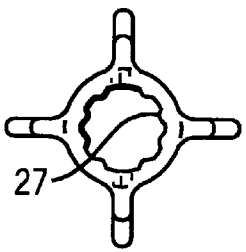
FIG. 5 is a rear view of a different embodiment of the slide in FIG. 1 showing the additional feature of internal grooves of the slide.
Figure 4:
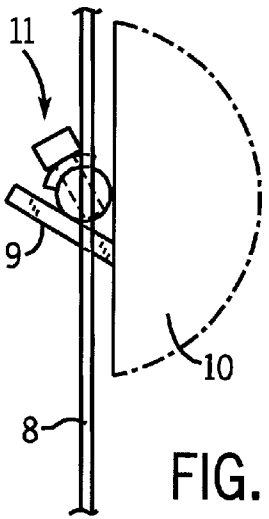
FIG. 4 is a fragmentary rear view of the relative position of the stop, the arrow rest, the bow handle and the bow string showing that the stop will not touch the arrow rest or the bow handle during release.

FIG. 5 shows a variation on the slide 3 in FIG. 1. The slide in FIG. 5 has internal grooves 27 formed in its interior surface. These grooves are formed so that grains of sand do not wedge between the slide and the arrow shaft.

Figure 6:
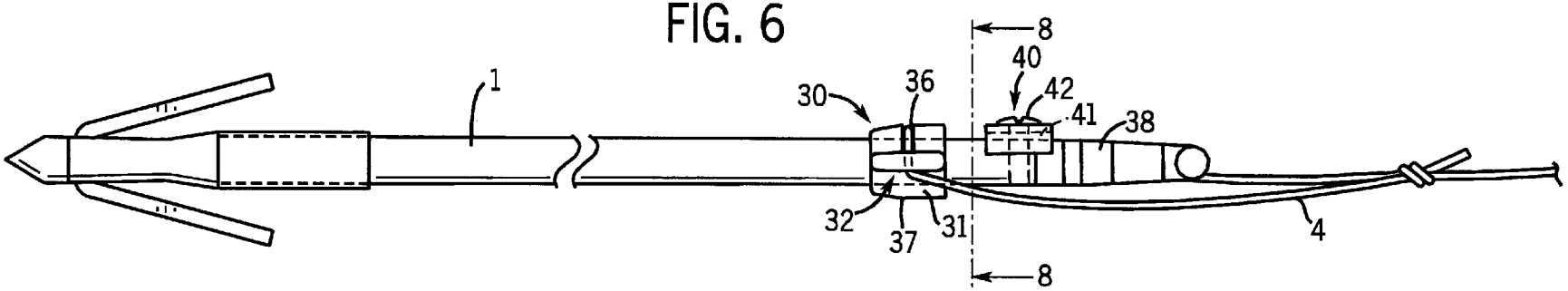
FIG. 6 is a view similar to FIG. 1 of another embodiment of this invention.
Figure 8:
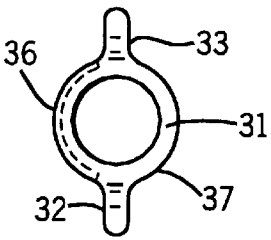
FIG. 8 is a rear view of the slide in FIG. 6.
Figure 7:
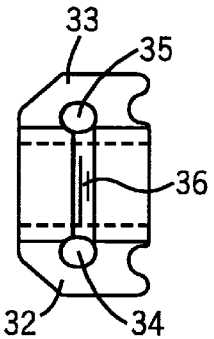
FIG. 7 is a top view of the slide in FIG. 6.

Referring to FIGS. 6–8, another embodiment of the slide and another embodiment of the stop of a bowfishing arrow are shown. A slide 30 in FIGS. 6–8 again is formed as a cylinder 31 which embraces the arrow shaft 1 and can slide on the arrow shaft 1. The slide 30 has only two vanes 32 and 33 that project radially outwardly from an outer wall surface 37 of the cylinder 31. The vane 32 has a fishing line passage 34 that is located at a position proximal to the cylinder 31. The vane 33 has a fishing line passage 35 that is located at a position proximal to the cylinder 31. A groove 36 on the outer wall surface 37 of the cylinder 31 extends from the vane 32 to the vane 33 on one side of the surface of the cylinder 31 defined by the vanes 32 and 33. The fishing line 4 attaches to the slide 30 by passing through one of the holes 34 and 35, tracking the groove 36 and then passing through the other hole. The line is then tied to itself to complete the attachment. Notice that since the fishing line 4 is entirely received within the groove 36, if the depth of the groove is approximately equal to the diameter of the line 4, that the aerodynamic shape of the cylinder of the slide 30 is maintained. Thus the slide 30 is more streamlined and less likely to impede the flight of the arrow. A stop 40 includes a pad 41 and a screw 42 which holds the pad 41 in place on the rearward end of the arrow shaft 1. The pad 41 can again be made of a resilient material such as urethane. As the bowfishing arrow in FIG. 1, the arrow 2 in FIG. 6 can be similarly wrapped with a tape 38 at a position immediately behind the stop 40 to further reduce wear on the fishing line.

Figure 9:
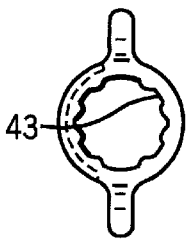
FIG. 9 is a rear view of a different embodiment of the slide in FIG. 6 showing the additional feature of internal grooves of the slide.

The slide 30 in FIG. 6 can also be similarly improved as the slide 3 in FIG. 1 by introducing internal grooves 43 to the slide to reduce the wedging of sand grains between the slid and the arrow shaft. The improved slide with the internal grooves 43 is shown in FIG. 9.

Figure 10:
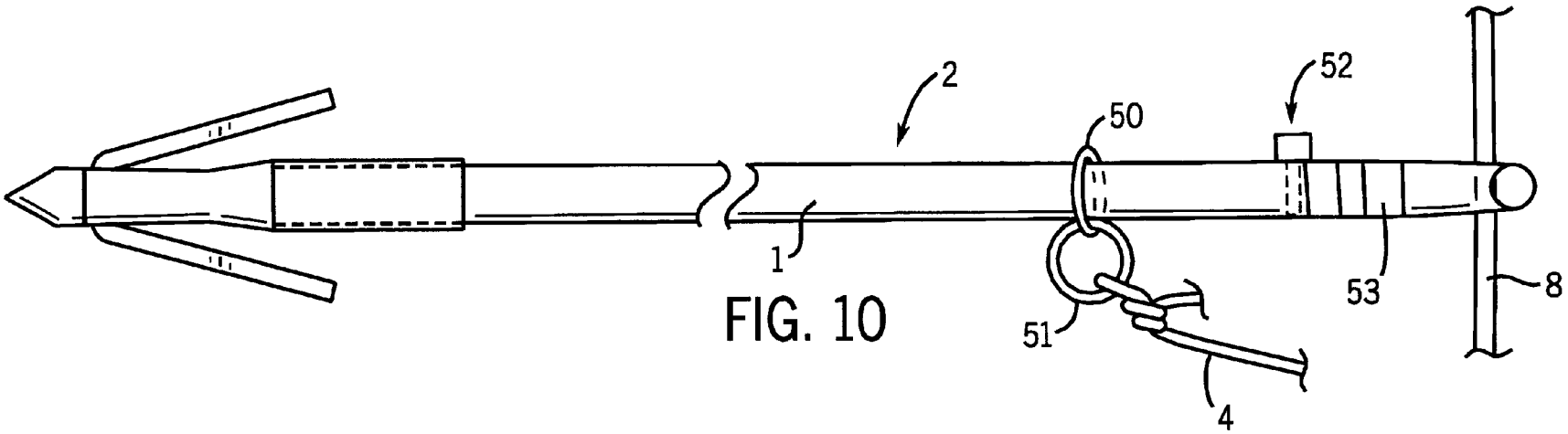
FIG. 10 is a view similar to FIG. 1 of another embodiment of this invention.

Referring to FIG. 10, another embodiment of a bowfishing arrow comprises a slide that has two interconnected welded wire rings 50 and 51 and a slide stop 52. The ring 50 embraces the arrow shaft and can slide back and forth on the arrow shaft. The ring 51 hangs from the ring 50 and receives fishing line 4, which is simply tied to it. The sizes of the rings 50 and 51 are such that binding of the ring 50 on the shaft is avoided. Preferably, the rings 50 and 51 are made of stainless steel. Using the rings as the slide of the bowfishing arrow can reduce the water drag in comparison to the bowfishing arrow shown in FIGS. 1 and 6. The stop 52 is a cap screw screwed onto the arrow shaft. The bowfishing arrow 2 in FIG. 10 can be improved by wrapping a tape 53 around the arrow shaft 1 at a position immediately behind the stop 52 to reduce wear on the fishing line and arrow shaft.

Figure 11:
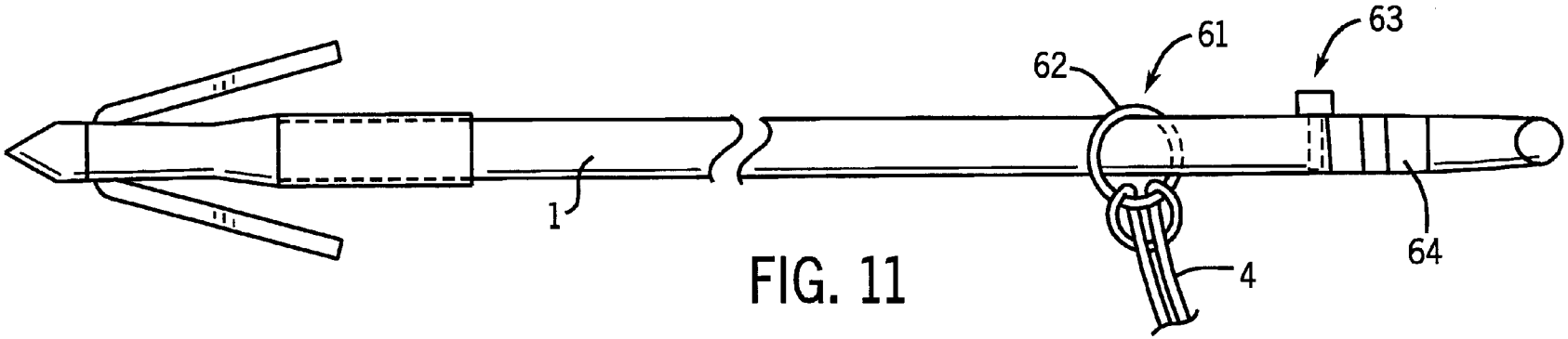
FIG. 11 is a view similar to FIG. 1 of another embodiment of this invention.

Referring to FIG. 11, another embodiment of the slide is shown. A slide 61 in FIG. 11 comprises a single wire ring 62. The ring 62 is in proper size so that when receiving a fishing line 4 to pass through it, it can slide on the arrow shaft 1 freely and avoid binding at the same time. A stop 63 in FIG. 11 is the same as the stop 52 in FIG. 10. A tape 64 may also be wrapped around the arrow shaft 1 at a position immediately behind the stop 63 to reduce fishing line and arrow shaft wear. The single ring arrangement can further reduce water drag in comparison to the bowfishing shown in FIG. 10.

Figure 12:
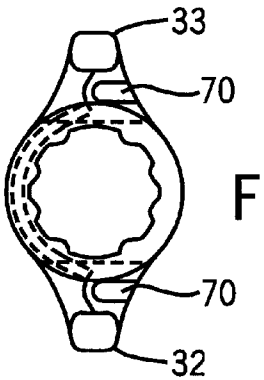
FIG. 12 is a view similar to FIG. 8 showing another variation of this invention.
Figure 13:
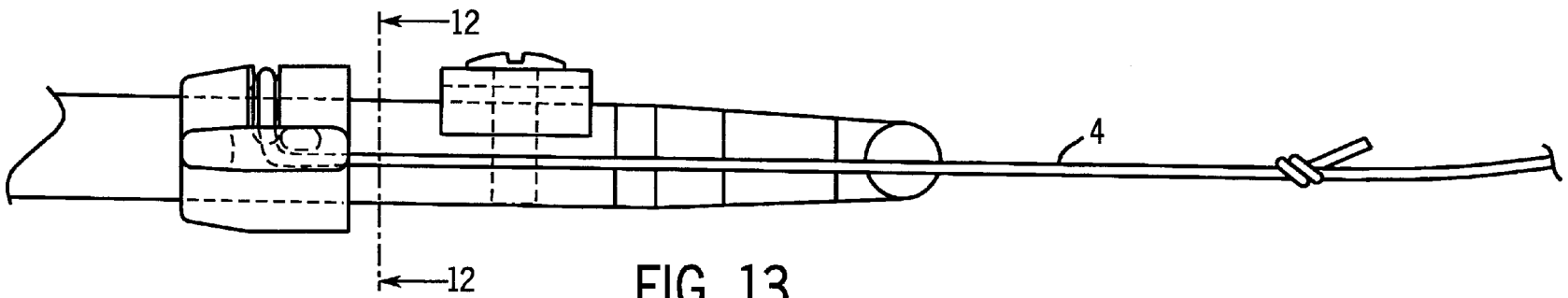
FIG. 13 is a side view of an arrow using the slide shown in FIG. 12.

Shown in FIG. 12 is another variant of the slide of the present invention. This variation is similar to that shown in FIG. 7, with the addition that wing grooves 70 have now been provided in the wings 32 and 33 of the slide. Shown in FIG. 13 is how the bowfishing line 4 attaches to the slide in this embodiment. Note that the provision for the wing grooves 70 permits the line 4 to travel inside those grooves and to be, in essence, hidden in the grooves as the arrow enters the fish. This is a particular advantage when bowfishing for fish with extremely sharp scales, like gar, since the line is protected from the scales during entry of the arrow into the fish. In addition, this arrangement allows the line to trail the arrow true on the center of flight of the arrow to help avoid any torque on the arrow which might alter its flight.

It is understood that the present invention is not limited to the particular embodiments described above, but embraces all such modifications and variations thereof as come within the scope of the following claims.

I claim:

1. A bowfishing arrow, comprising:

an arrow shaft with a point at its far end;

a generally cylindrical slide entrained on the arrow shaft to allow the slide to slide on the arrow shaft, the slide having a set of vanes projecting radially outwardly, at least one of the vanes having a passage in it adapted to receive a bowfishing line therethrough to attach the line to the slide; and a slide stop to restrain further travel of the slide on the arrow, wherein the arrow is adopted to being attached to the bowfishing bow by attaching the line to the slide, the slide being adapted to remaining in front of the bow handle and the bow string at all times to minimize the chances of tangling the line with the bowstring and any other part of the bow.

2. The bowfishing arrow of claim 1 wherein the slide has two vanes.

3. The bowfishing arrow of claim 2 where the slide also has rearwardly extending wing grooves formed in the vanes to receive the line.

4. The bowfishing arrow of claim 1 wherein the slide has four vanes.

5. The bowfishing arrow of claim 1 the slide stop includes a pad of resilient material to contact the slide.

6. The bowfishing arrow of claim 1 wherein the slide has a notch formed in it to receive the line, the line being passed through the notch and tied to itself.

7. A bowfishing bow and arrow, comprising:

a bow with a handle and a bowstring;

an arrow with a shaft with a point at its far end;

a slide entrained on the arrow shaft to allow the slide to slide on the arrow shaft; and a line attached to the bow at one end and attached to the slide at the other end, the slide being adapted to remaining in front of the bow handle and the bow string at all times when the bow is drawn to minimize the chances of tangling the line with the bowstring.

8. The bowfishing bow and arrow of claim 7 wherein the slide has two vanes.

9. The bowfishing arrow of claim 8 where the slide also has rearwardly extending wing grooves formed in the vanes to receive the line.

10. The bowfishing bow and arrow of claim 7 wherein the slide has four vanes.

11. The bowfishing bow and arrow of claim 7 further comprising a slide stop on the arrow to restrain reward movement of the slide on the arrow.

12. The bowfishing bow and arrow of claim 11 wherein the slide stop includes a pad of resilient material to contact the slide.

13. The bowfishing bow and arrow of claim 11 wherein the slide has a notch formed in it to receive the line, the line being passed through the notch and tied to itself.

14. A bowfishing arrow, comprising:

a slide having a cylinder which embraces an arrow shaft to allow the slide to slide on the arrow shaft and two vanes projecting radially outwardly from the cylinder, said cylinder has a groove on its outer wall surface extending from one vane to the other, each of the vanes has a fishing line hole at a position proximal to the cylinder; and a slide stop having a pad to absorb the impact of the slide when the slide slides back, and a screw to hold the pad in place on the arrow shaft near the arrow shaft's rearward end.

15. The bowfishing arrow of claim 14, further comprising a tape wrapped around the arrow shaft at a position immediately behind the stop.

16. The bowfishing arrow of claim 14, wherein the slide further comprising a plurality of internal grooves so that grains of sand do not wedge between the slide and the arrow shaft.

17. The bowfishing arrow of claim 14, wherein the pad of the stop is made of urethane.

18. A bowfishing arrow, comprising:

a slide having two interconnected welded wire rings with one embracing the arrow shaft and being able to slide on the arrow shaft and the other hanging from the ring embracing the arrow shaft for fishing line attachment; and a slide stop which comprises a cap screw screwed into the arrow shaft near the arrow shaft's rearward end.

19. The bowfishing arrow of claim 18, further comprising a tape wrapped around the arrow shaft at a position immediately behind the stop.

20. The bowfishing arrow of claim 18, wherein the tape is an electrical tape.

21. The bowfishing arrow of claim 18, wherein the wire rings are made of stainless steel.

22. A bowfishing arrow, comprising:

a slide having a wire ring of appropriate size so as the ring can slide along the arrow shaft and receive a fishing line passing through the ring without causing the fishing line-arrow shaft binding; and a slide stop which comprises a cap screw screwed into the arrow shaft near the arrow shaft's rearward end.

23. The bowfishing arrow of claim 22, further comprising a tape wrapped around the arrow shaft at a position immediately behind the stop.

24. The bowfishing arrow of claim 22, wherein the tape is an electrical tape.

25. The bowfishing arrow of claim 22, wherein the wire ring is made of stainless steel.

* * * * *

US006517453C1

(12) EX PARTE REEXAMINATION CERTIFICATE (10004th)

United States Patent
LaSee

(10) Number: US 6,517,453 C1
(45) Certificate Issued: Jan. 10, 2014

(54) BOWFISHING ARROW ATTACHMENT

(76) Inventor: Jack LaSee, Abbotsford, WI (US)

Reexamination Request:
No. 90/012,984, Sep. 10, 2013

Reexamination Certificate for:

| | |
|---|---|
| Patent No.: | **6,517,453** |
| Issued: | **Feb. 11, 2003** |
| Appl. No.: | **09/891,918** |
| Filed: | **Jun. 26, 2001** |

(51) Int. Cl.
*F42B 6/04* (2006.01)

(52) U.S. Cl.
USPC ..... 473/578; 124/86

(58) Field of Classification Search
None
See application file for complete search history.

(56) References Cited

To view the complete listing of prior art documents cited during the proceeding for Reexamination Control Number 90/012,984, please refer to the USPTO's public Patent Application Information Retrieval (PAIR) system under the Display References tab.

*Primary Examiner* — Jeffrey R Jastrzab

(57) ABSTRACT

The present invention provides an improved bowfishing arrow that prevents the bowfishing line from tangling with the bow string during release which can cause the arrow to snap back to cause serious injury. The improved arrow achieves this prevention by including a slide and a stop on the arrow shaft. The bowfishing line is tied to the slide which stays in front of the archer's hand and the arrow rest during drawback. After arrow release, the slide slides back to the stop, which is located close to the rearward end of the arrow. The stop is designed to not touch the arrow rest or the bow handle during release. Because the slide slides back to the rearward end of the arrow during release, the rubbing of the fishing line against the arrow shaft and thus the wear of the fishing line is greatly reduced.

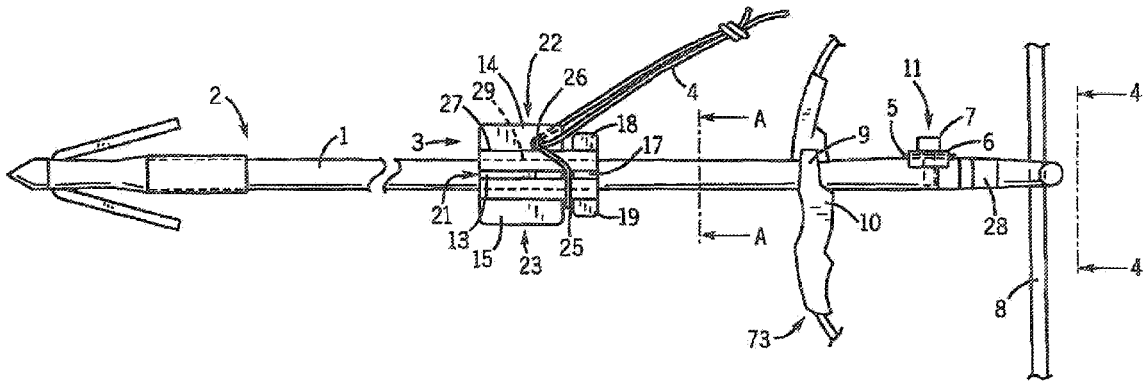

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4, 5, 11, 18, 21, 22 and 25 are cancelled.

Claim 7 is determined to be patentable as amended.

Claims 8, 10 and 12, dependent on an amended claim, are determined to be patentable.

New claims 26-34 are added and determined to be patentable.

Claims 3, 6, 9, 13-17, 19, 20, 23 and 24 were not reexamined.

7. A bowfishing bow and arrow, comprising:

a bow with a handle and a bowstring;

an arrow with a shaft with a point at its far end;

a *plastic* slide entrained on the arrow shaft to allow the slide to slide on the arrow shaft, *the slide providing a unitary body adapted to be formed by rnolding and having a central bore for receiving the shaft of the arrow to slide therealong and two passages on opposite sides of the central bore to receive a bowfishing line therethrough to attach the bowfishing line to the slide, wherein the slide is substantially free from obstruction between the two passages that would prevent the bowfishing line from passing freely through each of the two passages across a body of the slide to be tied to itself and, as tied, to slide with respect to the plastic slide so that the bowfishing line may true on the center of flight of the arrow to reduce torque on the arrow which might alter its flight;*

*a slide stop at a near end of the arrow to restrain farther travel of the slide on the arrow*; and a line attached to the bow at one end and attached to the slide at the other end *passing through the two passages and tied to itself*, the slide being adapted to [remaining] *remain* in front of the bow handle and the bow string at all times when the bow is drawn to minimize the chances of tangling the line with the bowstring.

*26. The bowfishing bow and arrow of claim 7 wherein the body of the plastic slide provides two passageways at opposite sides of the body as separated by an axis of the central bore each to receive a bowfishing line therethrough to attach the line to the slide.*

*27. The bowfishing bow and arrow of claim 26 wherein the body of the plastic slide provides a line guide surface across the slide conducting a tensioned bowfishing line between the two passageways without contacting the arrow shaft.*

*28. The bowfishing bow and arrow of claim 7 wherein the central bore includes a plurality of internal grooves so that grains of sand do not wedge between the slide and the arrow shaft.*

*29. The bowfishing arrow of claim 7 wherein the slide stop provides a resilient pad of material attached to the arrow shaft with a metal fastener extending radially through the resilient pad into the arrow shaft.*

*30. A bowfishing bow and arrow, comprising:*

*a bow with a handle and a bowstring;*

*an arrow with a shaft with a point at its far end;*

*a slide entrained on the arrow shaft to allow the slide to slide on the arrow shaft; and*

*a line attached to the bow at one end and attached to the slide at the other end, the slide being adapted to remain in front of the bow handle and the bow string at all times when the bow is drawn to minimize the chances of tangling the line with the bowstring;*

*further including a slide stop projecting radially from only one side of the arrow shaft at a rear of the arrow as is adapted to avoid interference with an arrow rest or bow handle and wherein the slide stop provides a resilient pad of material attached to the arrow shaft with a fastener having a fastener shaft extending radially into the arrow shaft.*

*31. The bowfishing bow and arrow of claim 30 wherein the body of the plastic slide provides opposed radial projections each having a passage in it adapted to receive bowfishing line therethrough to attach the line to the slide.*

*32. The bowfishing bow and arrow of claim 31 wherein the passageways are along axes substantially perpendicular to a central bore slidably receiving the arrow shaft.*

*33. The bowfishing arrow of claim 30 wherein the fastener is a metal screw.*

*34. The bowfishing arrow of claim 1, wherein the slide further includes a plurality of internal grooves so that grains of sand do not wedge between the slide and the arrow shaft.*

* * * * *